US011142898B2

(12) United States Patent
Le et al.

(10) Patent No.: US 11,142,898 B2
(45) Date of Patent: Oct. 12, 2021

(54) MODULAR FLUID VALVE

(71) Applicant: Fluidmaster, Inc., San Juan Capistrano, CA (US)

(72) Inventors: Tuan Van Le, Fountain Valley, CA (US); Joseph Unkyung Han, Irvine, CA (US); Salvador Pena, Menifee, CA (US)

(73) Assignee: FLUIDMASTER, INC., San Juan Capistrano, CA (US)

( * ) Notice: Subject to any disclaimer, the term of this patent is extended or adjusted under 35 U.S.C. 154(b) by 0 days.

(21) Appl. No.: 16/388,689

(22) Filed: Apr. 18, 2019

(65) Prior Publication Data

US 2019/0323219 A1 Oct. 24, 2019

Related U.S. Application Data

(60) Provisional application No. 62/659,690, filed on Apr. 18, 2018.

(51) Int. Cl.
*E03D 3/12* (2006.01)

(52) U.S. Cl.
CPC ..... *E03D 3/12* (2013.01)

(58) Field of Classification Search
CPC ..... E03D 1/30
USPC ..... 4/405, 378
See application file for complete search history.

(56) References Cited

U.S. PATENT DOCUMENTS 5,385,788 A 1/1995 Charleston
6,934,976 B2 * 8/2005 Parsons ..... E03D 1/142 251/29
8,095,997 B2 * 1/2012 Harris ..... E03D 9/02 4/313
2003/0106587 A1 6/2003 Taylor et al.
2009/0019627 A1 1/2009 Le et al.
2012/0012197 A1 1/2012 Song
2015/0013057 A1 * 1/2015 Bucher ..... E03D 9/035 4/378

FOREIGN PATENT DOCUMENTS

KR 20-0243333 Y1 10/2001

OTHER PUBLICATIONS

International Search Report and Written Opinion for International Application No. PCT/US2019/028193, dated Aug. 7, 2019, 11 pages.

* cited by examiner

*Primary Examiner* — Lori L Baker
(74) *Attorney, Agent, or Firm* — Greenberg Traurig, LLP

(57) ABSTRACT

A fluid valve with a modular and/or replaceable fluid control assembly is disclosed, and is configured and arranged to require maintenance over a product life of the fluid valve. The modular and/or replaceable fluid control assembly includes at least one portion including a setting or presetting configured and arranged to control fluid flow behavior in the fluid valve. The setting or presetting is useable to control fluid flow in the modular and/or replaceable fluid control assembly after an upgrade or replacement of at least a portion of the modular and/or replaceable fluid control assembly. Further, the setting or presetting enables the modular and/or replaceable fluid control assembly to retain the fluid flow behavior following one or more upgrades or replacements of one or more portions of the modular and/or replaceable fluid control assembly.

12 Claims, 5 Drawing Sheets

MODULAR FLUID VALVE

CROSS-REFERENCE RELATED APPLICATIONS

This application claims the benefit of and priority to U.S. Provisional Application No. 62/659,690, filed on Apr. 18, 2018, the entire contents of which are incorporated herein by reference.

BACKGROUND

Water is becoming an increasingly scarce and valuable commodity. Accordingly, there is an increasing need to develop fluid control systems (e.g., flush systems of toilet tanks, and other fluid handling or delivery systems) that improve fluid transfer accuracy, precision, and/or efficiency, and deliver lower fluid volumes (e.g., by using fewer gallons per flush of a toilet system). For example, fill or inlet valves in conventional fluidic systems typically control the flow of a fluid such as water for refilling a fluid reservoir, and deliver the fluid from a tank to a bowl during a flush cycle of a toilet system. Fill valves are typically one of the items in the toilet tank that requires maintenance during the life of the toilet system.

A typical toilet tank in a conventional gravity fed toilet includes an activation device such as a trip lever, a fill valve to supply water to the tank and/or bowl from the water supply, and a flush valve to deliver water from the tank to the toilet bowl to create a flush. The flush valve is designed to open when a user activates the trip lever to transfer water from the tank to the bowl at a relatively high flowrate (per each toilet design requirement), and to close when the water level in the tank reaches a specific point so that the desired total flush volume can be repeatedly provided based on applicable building codes.

The fill valve is usually factory set to shut off at a certain water level relative to the tank and/or overflow tube of a flush valve based on a relevant building code, and to provide enough head pressure to maintain the performance of the flush valve and/or toilet. The fill valve can also be designed to provide two water paths to supply water to the tank while filling the bowl in a siphonic toilet. The percentage of bowl refill to the tank refill varies from toilet to toilet according to a toilet manufacturer's specifications.

Given, the increasing accuracy and efficiency requirements of fluid handling systems, there exists a need to provide a more accurate and precise flush volume control that includes specific settings and/or adjustable settings that last the life of the product. There is also a need to reduce replacement and repair costs and complexity, and to provide extended product lifetimes without the need to alter or adjust any prior factory or installation settings. In a conventional toilet valve system, adjusting the fluid tank settings or trims is typically a challenge. For example, a user may have difficulties when replacing a fill valve when they may need to determine the settings needed to set the original water level to prevent wasting water and/or to avoid incorrect bowl filling for correct siphon flushes. The user often finds the process to be an exceptionally time-consuming process and they may not have the confidence or skills to select the correct settings. Further, the user may have difficulties when replacing a flush valve, where they may need to determine how to set the flapper to maintain the original residual water so that the right amount of flush volume can be repeatedly provided. Again, the process is time consuming, and the end-user may not have the necessary confidence or skills to assure the use of original settings to provide the intended performance.

These challenges can also impact product manufacturers, where, for example, a manufacturer's reputation may be damaged if the toilet performance is degraded with retail replacements without matched configurations. The manufacturer may not be able to provide cost-effective solutions in the replacement markets since there are often too many trim versions to consider. Thus, manufacturers may need to carry multiple replacement fill valves and/or flush valves if the end customer wants to order the genuine manufacturer replacements. Further, the manufacturer may need to expend additional resources on customer services when end-users are not satisfied with the products, even when the products are tuned with the correct trims.

SUMMARY

Some embodiments include a fluid valve comprising a modular and/or replaceable fluid control assembly configured and arranged to require maintenance over a specified product life of the fluid valve. In some embodiments, the modular and/or replaceable fluid control assembly includes at least one portion including a setting or presetting configured and arranged to control fluid flow behavior in the fluid valve. Further, the setting or presetting can be useable to control fluid flow in the modular and/or replaceable fluid control assembly before or after an upgrade or replacement of at least a portion of the modular and/or replaceable fluid control assembly. Further, in some embodiments, the setting or presetting can enable the modular and/or replaceable fluid control assembly to retain the fluid flow behavior following one or more upgrades or replacements of one or more portions of the modular and/or replaceable fluid control assembly.

In some embodiments, the at least one modular and replaceable assembly comprises a fill valve. In some further embodiments, the fill valve can be removably coupled to a fluid supply line. Some embodiments further comprise an actuator that can initiate at least one flush of a fluid reservoir in which the fluid valve is installed. In some embodiments, the actuator comprises a dual-flush actuator that can control a flush volume exiting the fluid reservoir following user-actuation of the actuator. In some embodiments, the at least one modular and replaceable assembly comprises a flush valve.

Some embodiments further comprise a diverter valve comprising a variably closeable channel. In some embodiments, the diverter valve comprises incremental settings of the variable closable channel. In some further embodiments, the diverter valve comprises continuously variable settings of the variable closable channel.

Some embodiments further comprise a fill valve level sensor that is moveably coupled to a support structure, where the fill valve level sensor is able to control or set a fluid fill volume. Some embodiments further comprise a flush valve level sensor moveably coupled to a support structure that can control or set a fluid flush volume. Some embodiments further comprise a fill manifold structure including two channels, where fluid flow to the two channels is controlled with a diverter valve. In some embodiments, the one of the two channels can direct fluid flow to a reservoir, and a second channel of the two channels can direct fluid flow to a fluid bowl.

Some embodiments include a fluid control system comprising a fluid reservoir, and a modular fluid control assembly coupled to the fluid reservoir. In some embodiments, the modular fluid control assembly includes at least one setting or presetting that can control fluid flow in the fluid control system. Further, in some embodiments, the modular fluid control assembly can include at least one component designed to be substantially maintenance-free during a specified lifetime of the fluid control system, and at least one component designed to be maintained or replaced in the fluid reservoir during the specified lifetime of the fluid control system. Further, in some embodiments, at least one component can be designed to be substantially maintenance-free during a specified lifetime of the fluid control system, and can comprise the setting or presetting that can control the fluid flow in the modular fluid control assembly after replacing or upgrading or maintaining the at least one component that is designed to be maintained or replaced in the fluid reservoir during the specified lifetime.

In some embodiments of the fluid control system, the at least one modular fluid control assembly comprises a replaceable flush valve and/or a replaceable fill valve. Some embodiments further comprise a diverter valve comprising a variably closeable channel. In some embodiments of the fluid control system, the diverter valve comprises incremental settings or continuously variable settings of the variable closable channel.

Some embodiments of the fluid control system further comprise a fill valve level sensor moveably coupled to a support structure. In some embodiments, the fill valve level sensor can control or set a fluid fill volume, and a flush valve level sensor can be moveably coupled to the support structure, and can control or set a fluid flush volume.

Some embodiments further comprise a fill manifold structure including two channels, where fluid flow to the two channels is controlled with a diverter valve. Some embodiments further comprise an actuator that can initiate at least one flush of a fluid reservoir in which the fluid valve is installed.

DETAILED DESCRIPTION

Figure 1:
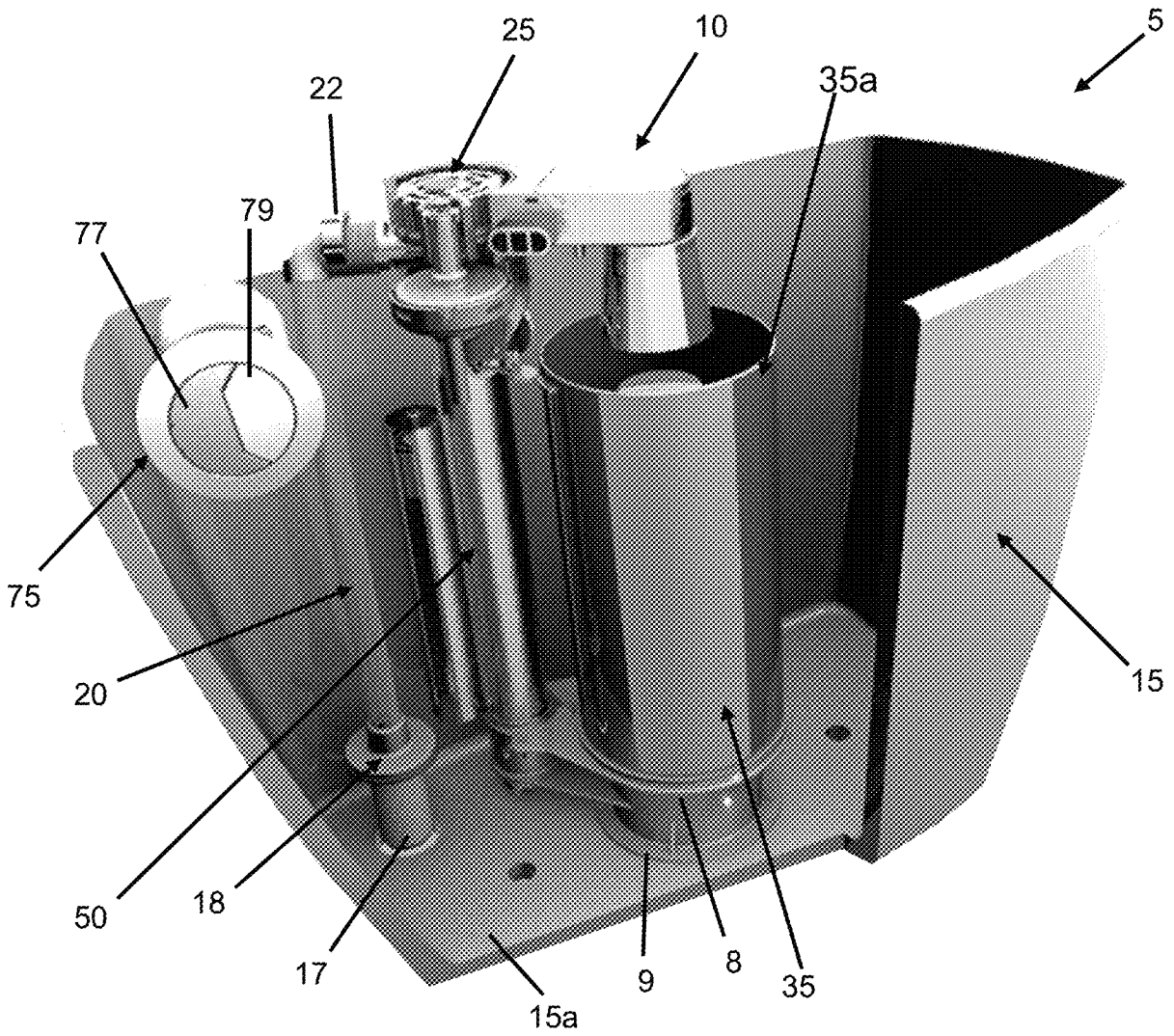
FIG. 1 illustrates a toilet system including an installed flush and inlet valve assembly in accordance with some embodiments of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," "in communication with," and "coupled" and variations thereof are used broadly and encompass integrated, integral with and both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives that fall within the scope of embodiments of the invention.

Some embodiments of the invention provide a system which maintains consistent fluid performance (e.g. water consumption, MaP which also known as Maximum performance testing, etc.) throughout the life of the fluid system substantially or completely independent of user maintenance, whereby original equipment manufacturers can promote their toilets as green and "Eco Friendly" products.

In some embodiments, any of the flush and/or valve assemblies described herein can fluidly couple to one or more hydraulic toilet sub-systems from the incoming fluid through to the waste fluid exit. The fluids described herein can be a gas or gas mixture such as air, or a liquid, such as water. In some embodiments, the fluids can include air and water. In some embodiments, the coupling can be a direct fluid contact and/or via communication via diaphragms, valves, bellows, or other devices.

Some embodiments include a modular fill valve module that can be easily removed and replaced without any need for any setting or resetting of water level, bowl and tank refill or height. In some embodiments, any of the assemblies or sub-assemblies described herein can be modular. For example, some embodiments include a connection or combination of hydraulic assemblies or sub-assemblies, including, but not limited to, activation assemblies or systems, reservoir inlet valves, reservoir outlet valves, waste fluid control assemblies, etc. In some embodiments, coupling or connection can be manual, intuitive, and with "no tools required", such as by using techniques such as a snap, click, slide, insert, twist, push, pull, and other known techniques.

Some embodiments include a system architecture including a trim system that prevents substitution of competitors' products. Some embodiments enable ease of serviceability by creating a cartridge style fill valve replacement part (e.g., a genuine OEM replacement part), for which the do it yourself ("DIY") customer does not need to adjust one or more settings such as refill rate, valve height, and float settings. Some embodiments include a cartridge style fill valve replacement part which provides lower manufacturing and shipping costs.

Some embodiments enable ease of serviceability by including level controls for the flush valve, and a modular design so that the DIY customer does not need to adjust any settings when tuning the flush valve. Some embodiments include a system architecture that provides the opportunity to comply with and potentially influence municipality codes and standards as user maintenance and repair cannot change the system's water consumption.

Some embodiments relate to a system for controllably supplying fluid to at least one reservoir such as a toilet tank. Some embodiments include systems and method for controlling the fluid flow to a reservoir and the fluid level in a reservoir. Referring to FIG. 1, illustrating an installed flush and inlet valve assembly 10 in at least a portion of a toilet system 5, some embodiments include a flush and inlet valve assembly 10 that can be operated by a user to produce a controlled flush or controlled fill. As illustrated, some embodiments include a structure that is integrated with the base 8 of a flush valve module 35 coupled to a flush outlet 85 (see FIG. 3), where the flush and inlet valve assembly 10 can be installed into a fluid tank or cistern 15. For example, in some embodiments, the flush and inlet valve assembly 10 can be mounted or coupled (i.e., installed) to a cleat 9 including a flush seal secured to a base 15*a* of the fluid tank or cistern 15.

In some embodiments, the flush and inlet valve assembly 10 includes a coupled fill line 20 coupled to a fastener 17 via a support 18. In some embodiments, the fastener 17 can be fastened to the lower surface 15*a* of the toilet tank 15. In some embodiments, the fluid line 20 can provide fluid communication between the fill valve module 25 and a water supply. In some embodiments, during a fill and/or flush action, fluid (e.g., water, grey water, water/air mixtures, effluent water, drinking water, flushing solution, etc.) can flow from the fluid line 20 through portions of the fill valve module 25.

In some embodiments, the fastener 17 and fluid line 20 can be removably attached to the toilet tank 15. For example, in some embodiments, the fluid line 20 may comprise a proximal end adjacent to the lower surface 15*a* of the tank 15, and a distal end near the fill valve module 25. In some embodiments, fluid line 20 can be removably coupled to the fill valve module 25, where the fluid line 20 is operatively coupled to a fastener 22 adjacent the fill valve module 25. In some embodiments, the fasteners 17, 22 can be externally or internally threaded or otherwise configured to be removably attached to the fluid line 20 and the fill valve module 25. In some embodiments, the fluid line 20 may comprise a flexible or pliable material, such as a conventionally known hose material.

Figure 2:
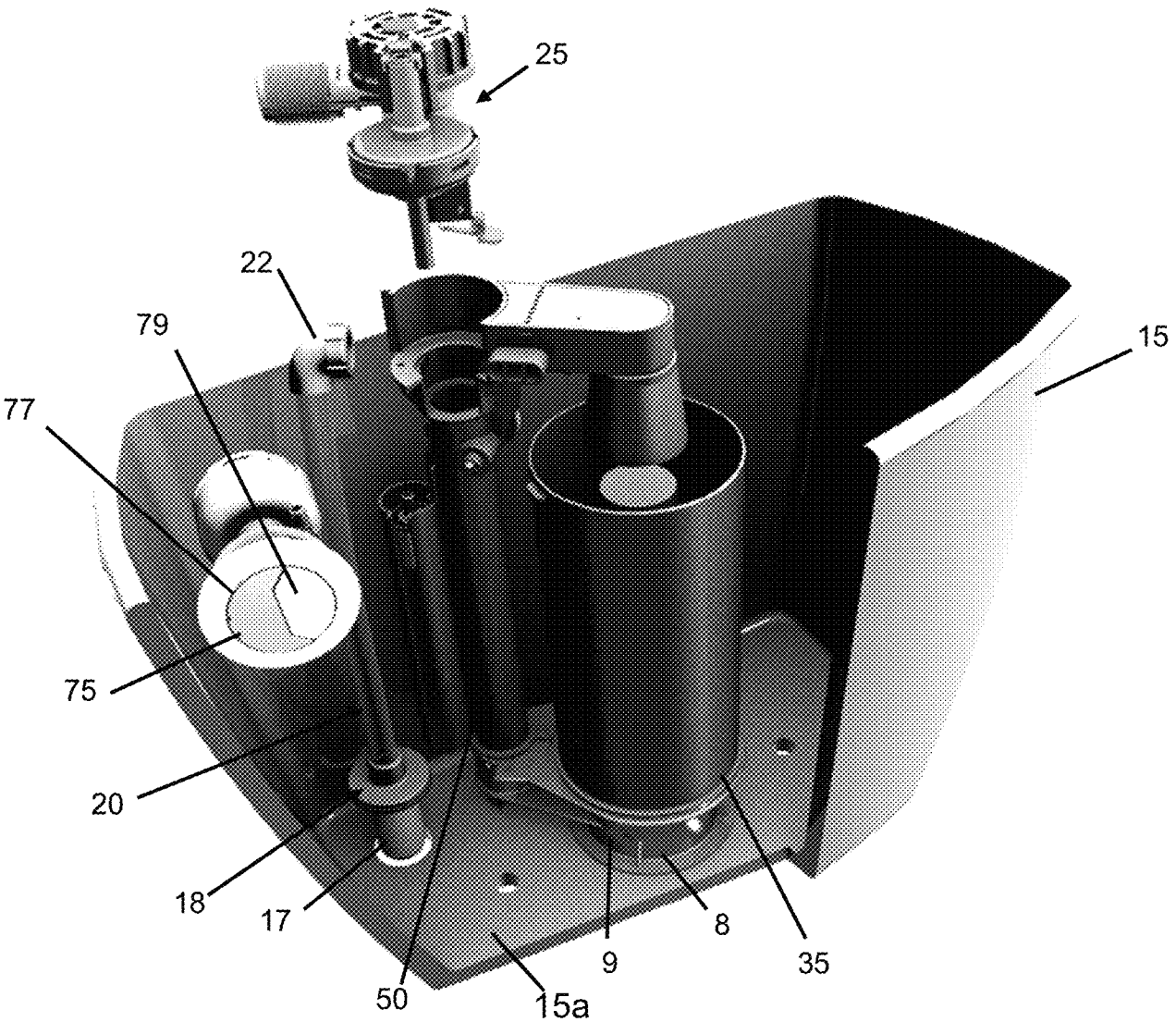
FIG. 2 illustrates an assembly view of the installed flush and inlet valve assembly of FIG. 1, showing a replaceable fill valve in accordance with another embodiment of the invention.

Referring to FIG. 2, showing an assembly view of the installed flush and inlet valve assembly of FIG. 1, a replaceable fill valve module 25 is shown uncoupled from the fill manifold structure 50. In some embodiments, the fill valve module 25 can be mounted at a defined location at the top of the structure where its outlet is positioned in water channels of the fill manifold structure 50. In some embodiments, when the fill valve module 25 is set to an "on" position, fluid can flow through the fill valve module 25, and can be split into two different channels of the fill manifold structure 50, where one channel is directed to the tank 15, and one channel is directed to a toilet bowl through an elbow at the bottom of the structure to the base of the flush valve 35 (described further below in relation to FIGS. 4 and 5).

Figure 3:
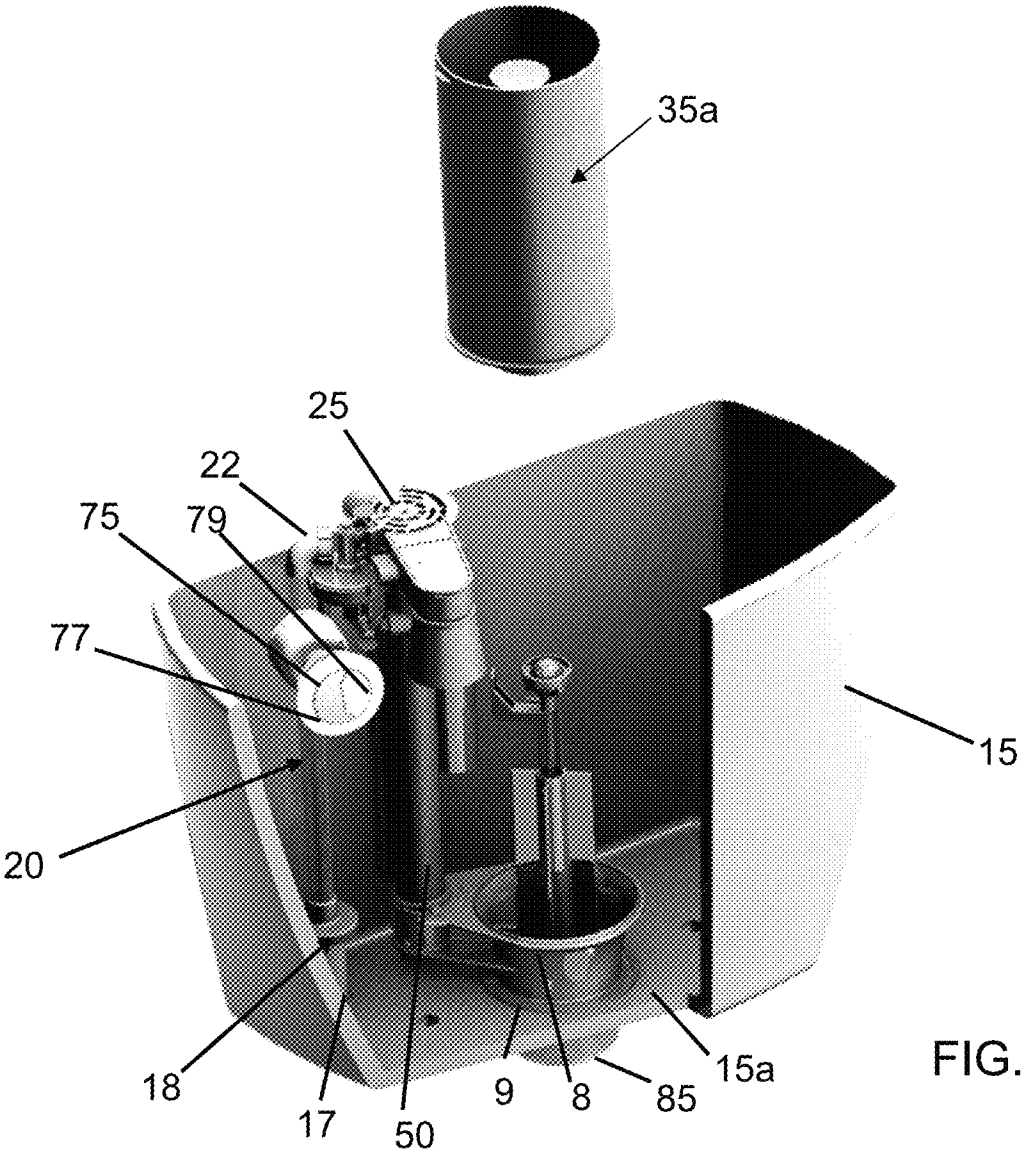
FIG. 3 illustrates an assembly view of the installed flush and inlet valve assembly of FIG. 1, showing a replaceable flush valve module in accordance with another embodiment of the invention.
Figure 4:
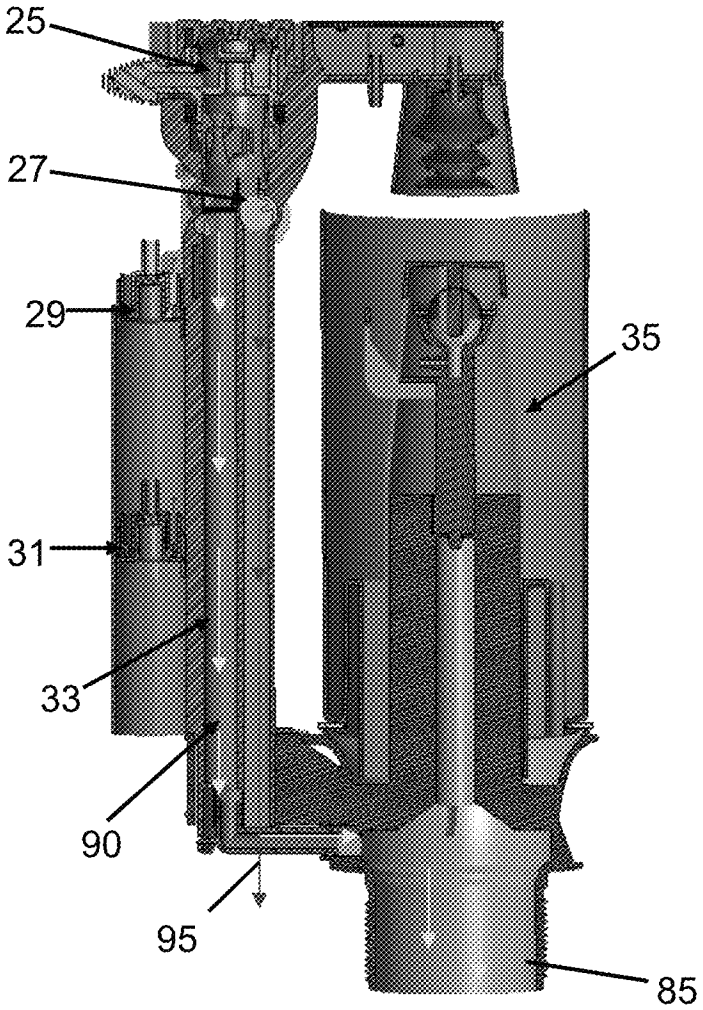
FIG. 4 illustrates a cross-sectional view of the flush and inlet valve assembly of FIG. 1 in accordance with some embodiments of the invention.

Further, referring to the assembly view of FIG. 3, and FIG. 4, illustrating a cross-sectional view of the flush and inlet valve assembly 10 of FIG. 1, in addition to the flush valve module 35, the flush valve top 35*a* is another portion of the flush and inlet valve assembly 10 that can be maintained overtime. In this case, it can be removed and swapped with a new one without the need to be reset for its shut-off point since the level sensor is already set on the structure of the design. As such, in some embodiments, the flush and inlet valve assembly 10 can comprise some components that are destined to be replaced over the life of the product, while other portions or components of the system can remain with the original equipment. In some embodiments, the portions or components of the system that remain with the original equipment can include one or more settings or presets. In some embodiments, some portions or components of the flush and inlet valve assembly 10 can require maintenance over a specified product life of the flush and inlet valve assembly 10 or a product including the flush and inlet valve assembly 10. In some embodiments, the flush and inlet valve assembly 10 includes at least one portion or component including a setting or presetting that can control fluid flow behavior in the flush and inlet valve assembly 10. In some embodiments, the setting or presetting can be used to control fluid flow in the flush and inlet valve assembly 10 after an upgrade or replacement of at least a portion or component of the flush and inlet valve assembly 10. In some embodiments, the setting or presetting enables the flush and inlet valve assembly 10 to retain the fluid flow behavior following one or more upgrades or replacements of one or more portions of the flush and inlet valve assembly 10.

In some embodiments of the invention, the flush and inlet valve assembly 10 can provide multiple fluid control functions. For example, in some embodiments of the invention, the flush and inlet valve assembly 10 can enable the mounting of the fill valve module 25 (e.g., using mounting structure 33). In some other embodiments of the invention, the flush and inlet valve assembly 10 can enable the channeling of water through the flush outlet 85 from the fill valve module 25 to the toilet bowl (shown as fluid flow 90).

Figure 5:
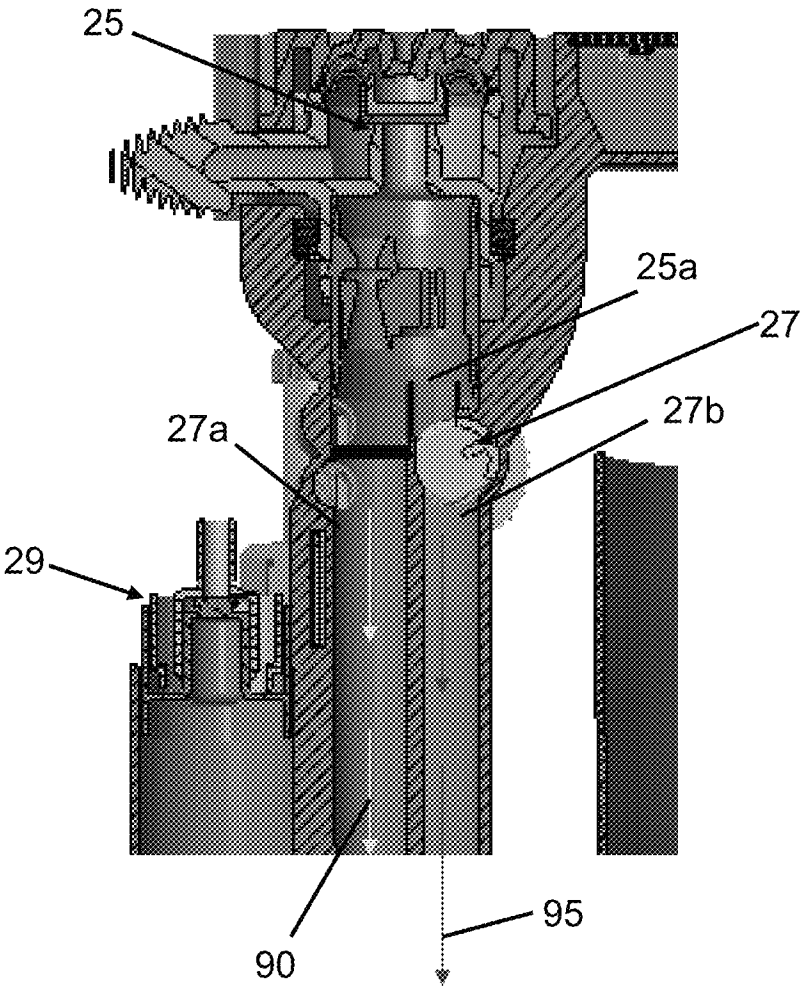
FIG. 5 is a close-up view of the flush and valve assembly shown in FIG. 4, in accordance with some embodiments of the invention.

In some embodiments of the invention, the flush and inlet valve assembly 10 can enable the mounting of a diverter valve 27 that can be used to control the percentage of the outlet water (shown as fluid flow 95) from the fill valve module 25 to the tank 15 and to the bowl (not shown) using a variably closeable channel. FIG. 5 is a close-up view of the flush and valve assembly 10, and shows diverter valve 27 located between the outlet 25*a* of the fill valve module 25 and the two flow channels 27*a*, 27*b* of the structure. In some embodiments, the diverter valve 27 can be used to control a specific amount of fluid to the tank 15 relative to the bowl. In some embodiments, the diverter valve 27 can comprise incremental settings that can provide incremental positions of the diverter valve 27. In other embodiments, the diverter valve 27 can comprise a continuously variable valve providing a continuously variable channel from an input side to an output side of the diverter valve 27. In some embodiments, the diverter valve 27 can be factory set.

Some embodiments include a flush and inlet valve assembly 10 that can be operated by a user to enable a controlled fluid flush from a reservoir or tank 15 and/or a controlled fluid fill (to a reservoir or tank 15) without a requirement for application of significant mechanical force, movement, and/or effort by the user. For example, some embodiments include a push-button activation for opening and closing one or more valves and/or vents to enable a controlled fluid transfer (e.g., a controlled fluid fill or a controlled fluid flush to or from the reservoir or tank 15). In some embodiments, the duration of the flush and/or the total volume of fluid of the flush can be controlled using a push-button or other switch, lever, toggle, or other conventional activator method. In some embodiments, the functions of the flush and inlet valve assembly 10 can be activated by a one-time activation of the push-button or switch/activator. In some further embodiments, the push-button, switch or activator can activate a flush and/or fill using a one-time activation regardless of the user contact time or force on the push-button or other switch or activator.

Referring to FIG. 1, showing the inlet valve assembly 25 of the flush and inlet valve assembly 10, some embodiments include a push-button actuator 75 that can be used for opening and closing one or more valves or vents to enable a controlled flush (or controlled fill). In some embodiments, the inlet valve assembly 25 can be controllably and/or fluidly coupled to an actuator configured for a user to control a flush volume of the flush and inlet valve assembly 10. For example, some embodiments include the inlet valve assembly 25 that can include a half flush and/or a full flush connection fluidly coupled to an actuator 75 configured for a user to actuate and control a flush volume. For example, some embodiments include an actuator 75 that is configured to enable a user to control a flush volume of the flush and inlet valve assembly 10. In some embodiments, the actuator 75 can comprise a touchless actuator, and/or button actuator, and/or lever, and/or toggle, or other actuation means, or combinations thereof. Any user-operated actuator, switch or toggle can be implemented as the actuator 75. Some embodiments include a dual-flush volume capability. For example, some embodiments include an actuator 75 comprising a full flush actuator 77 and/or a half-flush or reduced-flush actuator 79. In some further embodiments, the duration of the flush and/or the total volume of fluid of the flush can be controlled using a push-button or other switch, lever, toggle, or activator method.

In some embodiments, the flush and inlet valve assembly 10 can include adjustable flush levels. In some embodiments, one or more vents can be positioned at the fluid reservoir fluid elevation where valve action is desired. In some embodiments, the vents can be configured and arranged on the flush and inlet valve assembly 10 to function as fluid level "sensors". For example, some embodiments include at least one sensor, actuator, and/or fluid control valve that functions to control fluid flow and/or pressure in portions of the flush and inlet valve assembly 10 such as the inlet valve 25 and/or outlet or flush valve 35. For example, in some embodiments, one or more sensors can be positioned or repositioned on the flush and inlet valve assembly 10 to change their immersion depth in a fluid tank or cistern and to affect or set a specific flush volume. For example, in some embodiments, one or more sensors can be variably positioned on a mounting leg or other supporting structure of the flush and inlet valve assembly 10. For example, in some further embodiments of the invention, the flush and inlet valve assembly 10 can enable the mounting of level sensors for the fill valve module 25 (shown as level sensor 29) and flush valve module 35 (shown as level sensor 31) coupled to mounting structure 33. In some embodiments of the invention, sensors such as the fill valve level sensor 29 can be set to a specific level. In other embodiments, a flush valve level sensor 31 can be set to a specific level. In some embodiments, these sensors can be set by the manufacturer, the installer, and/or the end-user, and can remain static without requirement for setting or resetting when other portions of the flush and inlet valve assembly 10 (e.g., the fill valve module 25 and/or the flush valve 35) are replaced and/or upgraded.

Some embodiments of the invention include a fluid control system such as the toilet assembly 5 including an installed, pre-installed, integrated, and/or coupled flush and inlet valve assembly 10 (including any of the flush assemblies described herein). For example, referring again to FIG. 1, a toilet system integration is shown that includes a toilet assembly 5 including a coupled or integrated fluid tank or cistern 15 with flush and inlet valve assembly 10. In some embodiments, the fluid control system includes the flush and inlet valve assembly 10 coupled to the fluid tank or cistern 15 that includes at least one setting or presetting that can control fluid flow in the fluid control system. Further, the flush and inlet valve assembly 10 has at least one component designed to be substantially maintenance-free during a specified lifetime of the fluid control system, and at least one component designed to be maintained or replaced in the fluid tank or cistern 15 during the specified lifetime of the fluid control system. In this instance, the at least one component that is designed to be substantially maintenance-free during a specified lifetime of the fluid control system can comprise the setting or presetting that can control the fluid flow in the flush and inlet valve assembly 10 after replacing, upgrading, or maintaining the at least one component that is designed to be maintained or replaced in the fluid tank or cistern 15 during the specified lifetime of the fluid control system.

In some embodiments, any of the flush assemblies described herein can be coupled to a hydraulic toilet system interfacing with the ceramic of the toilet for the purposes of mounting and directing fluid as necessary, and in some embodiments, can include the fluid in the bowl. In some embodiments, any of the flush assemblies described herein can utilize precision (e.g., plastic or polymer-based) manufacturing where the performance demands the precision. For example, as flush volumes are required to decrease, fluid flow characteristics must be enhanced to provide satisfactory flush performance. Conventional ceramic manufacturing techniques do not provide the ability to maintain accurate dimensional control with small tolerances. Using materials which can be fabricated with excellent dimensional control for those components where fluid flow characteristics must be carefully controlled can allow the use of coarse (ceramic) manufacturing technologies where toilet aesthetics, strength, and (harsh) chemical wear durability are required. As just one example, the decorative aspects of a toilet can be fabricated using ceramic materials which can enclose or be coupled to accurately fabricated plumbing components.

In some embodiments of the invention, at least a portion of any of the flush and inlet valve assemblies described herein can comprise a polymer-based material including one or more homopolymers, one or more copolymers, or mixtures thereof. In some embodiments, the material can comprise an elastomeric polymer such as rubber or silicone. In some embodiments, the rubber can be a natural rubber (e.g., such as natural gum rubber), a synthetic rubber, or combinations thereof. In some embodiments of the invention, the material can comprise a butyl or butylene rubber, ethylene propylene diene monomer rubber, neoprene rubber, nitrile rubber, silicone rubber, a polyurethane rubber, a fluorosilicone, chloroprene rubber, nitrile rubber, or combinations thereof. In some embodiments, the material can include recycled rubber. In some other embodiments, the materials can comprise a silicone sponge or foam or a polyurethane sponge or foam.

In some embodiments of the invention, at least a portion of the material of any of the flush and inlet valve assembly structures described herein can comprise a polymer-based matrix material including a dispersed secondary material. For example, some embodiments include a material that comprises one or more polymers infused with (or including a dispersion of) filler elements, filler compounds, and/or filler mixtures. For example, in some embodiments, at least a portion of the material can comprise a polymer-based matrix material including filaments or particles dispersed in a matrix to form a composite material. For example, some embodiments include a filler that can comprise a fibrous material. In some embodiments, at least a portion of the filler can be oriented in a preferred direction. In some other embodiments, the material can comprise a fiber-filled matrix material including natural or synthetic filaments dispersed in a matrix to form a fiber composite material. Some embodiments include a filler material at least partially dispersed through at least a portion of the material. In some embodiments, the filler material can be amorphous or crystalline, organic or inorganic material. In some other embodiments, the particle size of the filler material can be between 1-10 microns. In some other embodiments, at least some portion of the filler material can be sub-micron. In some other embodiments, at least a portion of the filler can comprise a nano-sized particle filler material.

In some embodiments, at least a portion of any of the flush and inlet valve assembly structures disclosed herein can be fabricated using hand cutting, die cutting, laser cutting, and water jet cutting, molding, injection molding, reaction injection molding, or combinations thereof.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. Various features and advantages of the invention are set forth in the following claims:

The invention claimed is:

1. A flush and inlet valve assembly comprising:
a fill manifold structure,
a fill level sensor, and
a replaceable fill valve module;
wherein the fill manifold structure is configured to be coupled to a base of a toilet tank;
wherein the fill manifold structure is configured to receive fluid from a fluid supply line;
wherein the fill level sensor is coupled to the fill manifold structure;
wherein the fill level sensor comprises at least one setting or presetting configured to control fluid flow from the fill manifold to the replaceable fill valve module;
wherein the replaceable fill valve module is removably coupled to the at least one fill manifold structure;
wherein the fill level sensor is configured to remain coupled to the fill manifold structure when the replaceable fill valve module is decoupled from the fill manifold structure; and
wherein the fill manifold structure is configured to remain coupled to the toilet tank when the replaceable fill valve module is decoupled from the fill manifold structure.

2. The flush and inlet valve assembly of claim 1,
the fill manifold structure further comprising a diverter valve, and
the fill manifold structure further comprising at least two flow channels;
wherein the diverter valve is positioned between the at least two flow channels and the replaceable fill valve module;
wherein the diverter valve is configured to control a specific amount of fluid to the tank relative to a toilet bowl.

3. The flush and inlet valve assembly of claim 1,
wherein the replaceable fill valve module is removably coupled to the top of the fill manifold structure; and
wherein the top of the fill manifold structure is configured to be distal from the base of the toilet tank.

4. The flush and inlet valve assembly of claim 1,
wherein the fill level sensor is configured to control a toilet tank refill level;
wherein the fill level sensor is configured to be variably positioned on the fill manifold structure.

5. The flush and inlet valve assembly of claim 1,
further comprising a flush level sensor;
wherein the flush level sensor is configured to control the volume of fluid flushed from the toilet tank to a toilet bowl.

6. The flush and inlet valve assembly of claim 5,
wherein the fill level sensor is configured to control a toilet tank refill level;
wherein the fill level sensor is configured to be variably positioned on the fill manifold structure; and
wherein the flush level sensor is configured to be variably positioned on the fill manifold structure.

7. A flush and inlet valve assembly comprising:
a fill manifold structure,
a flush level sensor, and
a replaceable flush valve module;
wherein the fill manifold structure is configured to be coupled to a base of a toilet tank;
wherein the fill manifold structure is configured to receive fluid from a fluid supply line;
wherein the flush level sensor is coupled to the fill manifold structure;
wherein the flush level sensor comprises at least one setting or presetting configured to control fluid flow from the fill manifold to the replaceable fill valve module;
wherein the replaceable flush valve module is configured to be removably coupled to a flush outlet;
wherein the replaceable flush valve module is configured to channel water through the flush outlet to a toilet bowl;
wherein the flush level sensor is configured to remain coupled to the fill manifold structure when the replaceable flush valve module is decoupled from the flush outlet; and
wherein the fill manifold structure is configured to remain coupled to the toilet tank when the replaceable flush valve module is decoupled from the flush outlet.

8. The flush and inlet valve assembly of claim 7,
the fill manifold structure further comprising a diverter valve, and
the fill manifold structure further comprising at least two flow channels;
wherein the diverter valve is positioned between the at least two flow channels and a replaceable fill valve module; and
wherein the diverter valve is configured to control a specific amount of fluid to the tank relative to the toilet bowl.

9. The flush and inlet valve assembly of claim 8,
wherein the replaceable fill valve module is removably coupled to the top of the fill manifold structure; and
wherein the top of the fill manifold structure is configured to be distal from the base of the toilet tank.

10. The flush and inlet valve assembly of claim 9,
wherein the fill manifold structure is configured to remain coupled to the toilet tank when the replaceable fill valve module is decoupled from the fill manifold structure.

11. The flush and inlet valve assembly of claim 7,
further comprising a fill level sensor;
wherein the fill level sensor is configured to control a toilet tank refill level; and
wherein the flush level sensor is configured to control the volume of fluid flushed from the toilet tank to the toilet bowl.

12. The flush and inlet valve assembly of claim 11,
wherein the fill level sensor is configured to be variably positioned on the fill manifold structure; and
wherein the flush level sensor is configured to be variably positioned on the fill manifold structure.

* * * * *